US005172833A

United States Patent [19]

Faulkner, III

[11] Patent Number: 5,172,833

[45] Date of Patent: Dec. 22, 1992

[54] MODULAR APPLICATOR HAVING A SEPARATE FLOW LOOP TO PREVENT STAGNANT REGIONS

[75] Inventor: W. Harrison Faulkner, III, Salinas, Calif.

[73] Assignee: Slautterback Corporation, Monterey, Calif.

[21] Appl. No.: 818,698

[22] Filed: Jan. 9, 1992

[51] Int. Cl.[5] ..... B67D 5/62

[52] U.S. Cl. ..... 222/146.5; 222/482; 222/504; 239/590; 251/129.15

[58] Field of Search ..... 222/146.2, 146.5, 504, 222/518, 559, 482; 239/590, 590.3, 590.5; 251/129.15

[56] References Cited

U.S. PATENT DOCUMENTS

| | | | |
|---|---|---|---|
| 4,066,188 | 1/1978 | Scholl et al. | 222/146.5 |
| 4,488,665 | 12/1984 | Locks et al. | 222/146.5 |
| 4,602,741 | 7/1986 | Faulkner, III et al. | 239/235 |
| 4,687,137 | 8/1987 | Boger et al. | 239/124 |
| 4,711,379 | 12/1987 | Price | 222/504 |
| 4,951,917 | 8/1990 | Faulkner, III | 251/129.15 |
| 5,024,709 | 6/1991 | Faulkner, III et al. | 156/69 |
| 5,027,976 | 7/1991 | Scholl et al. | 222/146.5 |

*Primary Examiner*—Kevin P. Shaver
*Assistant Examiner*—Philippe Derakshani
*Attorney, Agent, or Firm*—Schneck & McHugh

[57] ABSTRACT

A modular adhesive applicator assembly in which electrical, thermal and fluid communication between a main block and individual modules occur at one face of the main block and in which a separate flow loop within each module is provided to prevent adhesive degradation within the module. Each module has an inlet port in fluid communication with an opening in the main block. The inlet port is located at an intermediate region of a solenoid armature used to control flow from the inlet port to an outlet port. A high-volume adhesive flow path extends forwardly along the solenoid armature directly to the outlet port. A low-volume adhesive loop extends rearwardly along grooves within the exterior of the solenoid armature and then forwardly within a central bore of the solenoid armature. A radial bore to the central bore provides fluid communication to the high-volume adhesive flow path. The flow loop allows the introduction of adhesive along the intermediate region of the armature without requiring a seal along the length of the solenoid armature and without creation of stagnant regions in which adhesive can age.

16 Claims, 4 Drawing Sheets

MODULAR APPLICATOR HAVING A SEPARATE FLOW LOOP TO PREVENT STAGNANT REGIONS

TECHNICAL FIELD

The present invention relates generally to adhesive dispensing devices and more particularly to mechanisms for controlling the intermittent flow of adhesive from dispensing devices.

BACKGROUND ART

Hot-melt adhesives are used extensively for sealing cases and cartons progressing along an automated assembly line. U.S. Pat. No. 4,602,741 to Faulkner et al. teaches a multi-nozzle manifold assembly for depositing a pattern of parallel beads of adhesive along the surface of a carton flap. The flap may then be closed against a second flap to seal the carton.

In certain applications, it is necessary to apply parallel beads of adhesive having different lengths. For example, in order to seal one end of a cereal box, typically long beads of adhesive are applied to the major flaps of the box, while shorter beads are applied to the minor flaps. At times, a single flap may even have beads of different lengths.

One method of applying adhesive beads of different lengths is to provide a number of closely spaced adhesive dispensing stations along the path of the assembly line, with each station applying adhesive beads of the different lengths. A problem with such a setup is that the adhesives used in assembly line applications have a short set time in order to minimize the time required for assembly line carton sealing. Consequently, the adhesive undergoes some solidification as a carton travels between the dispensing stations.

A second method is described in U.S. Pat. No. 5,024,709 to Faulkner et al., which teaches an adhesive applicator in which a single dispensing station has a number of individually controlled devices to simultaneously apply adhesive. Thus, adhesive applied at one station does not begin to solidify as it moves to a second station. However, such a station requires a number of separate connections to one or more melt units which supply adhesive to the station. A preferred assembly would be one in which there is a single flow path from the melt unit to a multi-nozzle assembly having nozzles that can be individually controlled. One difficulty in the design of such an assembly is that it increases the likelihood of regions of stagnant adhesive along the flow path from the melt unit to the nozzle outlets. In the Faulkner et al. patents identified above, adhesive enters an applicator body at the back of a solenoid armature that is selectively displaced to start and stop adhesive flow to nozzle outlets. Thus, the flow is a linear, coaxial flow along the armature used to control flow. A linear flow path is less susceptible to creation of stagnant regions than a path that includes one or more angles.

Hot-melt adhesive degrades at a relatively rapid pace. For this reason, creation of eddies and regions in which no flow occurs is undesirable. While the linear flow along a solenoid armature reduces the likelihood of stagnant regions, requiring a linear flow along each solenoid armature of an assembly having a number of individually controlled devices reduces the modularity and compactness of the assembly.

U.S. Pat. No. 4,687,137 to Boger et al. teaches an adhesive dispensing apparatus which is different than the Faulkner et al. devices in that Boger et al. describes a modular assembly in which adhesive is fed partially down the length of an armature. However, a difficulty encountered in such an arrangement is that as the adhesive is fed to the intermediate region of the armature, there is an equal tendency for the adhesive to progress rearwardly along the armature as there is for the adhesive to move forwardly toward an outlet port. This tendency to move rearwardly can cause eddies and stagnant regions. Boger et al. teaches limiting the adhesive-receiving chamber along the armature to include only a small volume that is rearward of the adhesive feed. However, the potential of adhesive degradation occurring within this chamber is still significant. Moreover, sealing the chamber to prevent the leak of hot-melt adhesive along the armature is a difficult task, particularly for applications in which a low-friction seal is required to allow free movement of the armature during high speed activation and deactivation. U.S. Pat. No. 4,711,379 to Price teaches use of a pair of packing structures to seal the rearward portion of an armature.

It is an object of the present invention to provide a device for controlling the intermittent flow of adhesive material in which modularity and compactness are enhanced without an increased susceptibility to creation of eddies and stagnant regions which would promote adhesive degradation.

SUMMARY OF THE INVENTION

The above object has been met by a modular adhesive applicator and assembly in which adhesive that is channeled to a solenoid armature is provided with a major flow path to an outlet and a minor flow loop that follows a predetermined path away from the outlet for return via a central bore through the armature. That is, rather than attempting to inhibit adhesive flow rearwardly along the solenoid armature, a path is provided to ensure that such a flow occurs. The defined flow prevents adhesive from remaining within an isolated area during successive adhesive-application cycles. Thus, the assembly is less susceptible to material degradation.

The modular assembly includes a main block having an adhesive supply channel and a plurality of individually-energized connectors. Preferably, the main block also includes heaters to ensure that the adhesive remains in a molten state. A plurality of modules are coupled to the main block in a manner that allows the adhesive, the thermal energy and power to enter at a single face. Each module includes a housing having an inlet port in fluid communication with the adhesive supply channel of the main block. The housing also includes a solenoid coil and an outlet port.

Within each housing is a solenoid armature aligned to selectively block the outlet port of the housing. The solenoid armature is spring biased into a sealed position against the seat. Energization of the solenoid coil generates a magnetic flux that overcomes the bias of the spring, permitting flow from the inlet port to the outlet port. The present invention also provides a flow path along the exterior of the solenoid armature. At the end of the solenoid armature opposite to the outlet port, the adhesive enters the central bore. The central bore has an outlet located between the inlet port and the outlet port. While the flow along this loop is minor in comparison with the principal flow from the inlet port to the outlet port, the flow through the loop is sufficient to prevent age degradation of the adhesive material.

An advantage of the present invention is that by providing adhesive supply, power and thermal energy at a single face of the main block, modularity and compactness are enhanced. Another advantage is that the present invention does not require creation of a seal along the length of the solenoid armature. Because no seal is required, a low-friction mounting of the solenoid armature within the housing is possible.

BEST MODE FOR CARRYING OUT THE INVENTION

Figure 1:
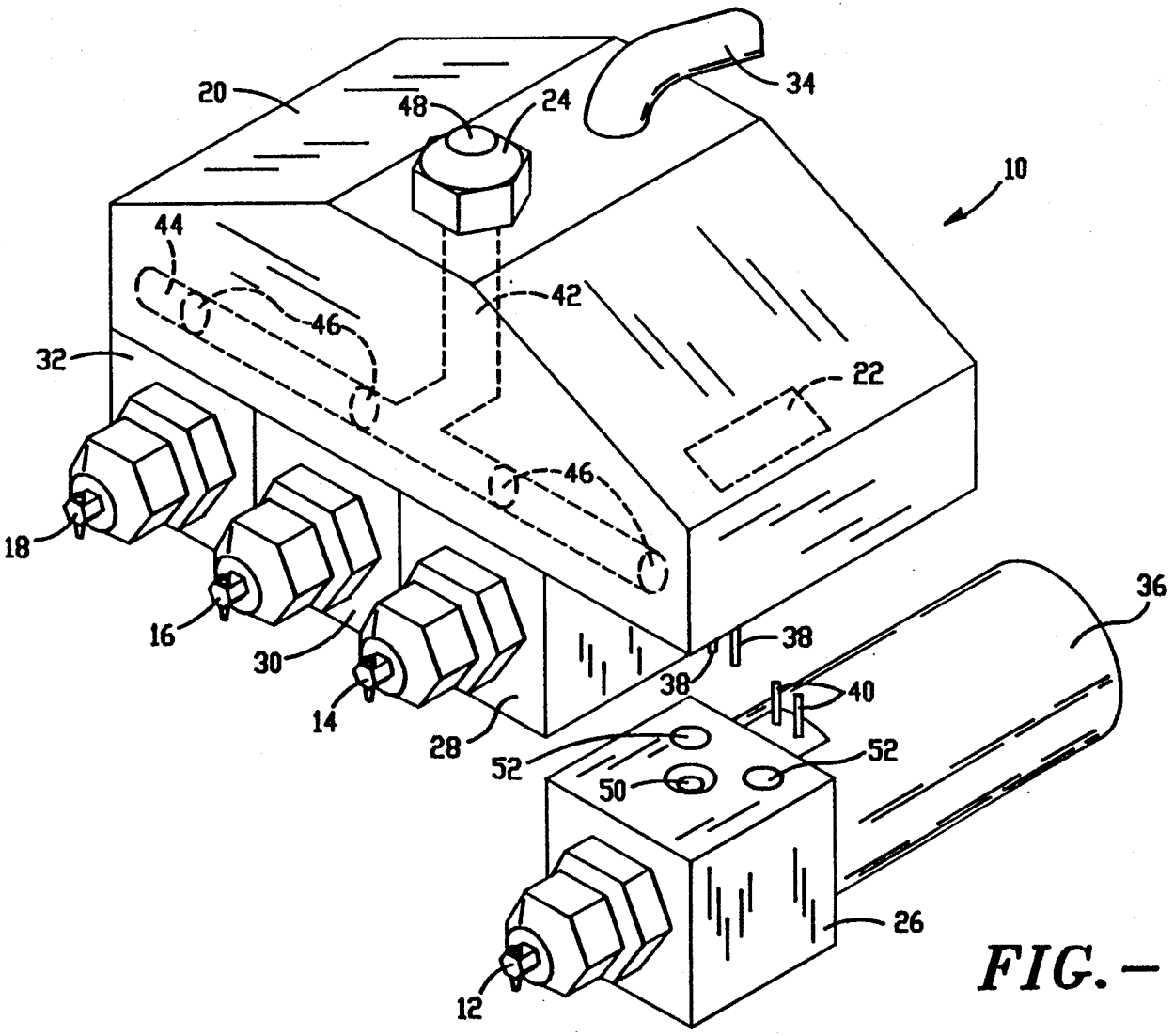
FIG. 1 is a perspective view of a modular adhesive application assembly in accord with the present invention.

With reference to FIG. 1, a modular assembly 10 for applying hot-melt adhesive from four nozzles 12, 14, 16 and 18 is shown. The assembly includes a main block 20 having at least one heating unit 22 to maintain hot-melt adhesive in a molten condition during passage from an inlet fitting 24 to the nozzles 12–18.

Four modules 26, 28, 30 and 32 are in high thermal energy transfer with the main block 20. The main block in the body of the modules should be made of a material having a high thermal coefficient. For example, aluminum may be used. A conduit 34 includes wiring for energizing the heating unit 22. The conduit also includes wiring necessary to selectively energize solenoid coils 36 of the modules 26–32. As will be explained more fully below, the modules are individually controlled for the release of adhesive from the nozzles.

Electrical communication between the main block 20 and a module 26–32 is via a two-prong jack 38 on the main block and two-prong plug 40 on the module. Fluid communication between the main block and the individual modules is via an adhesive supply channel 42 and a transverse bore 44 to openings 46 of the main block. The adhesive is received within the main block through a bore 48 in the inlet fitting 24. From the main block openings 46, adhesive enters inlet ports 50 at the tops of the modules 26–32.

Thus, thermal, electrical and fluid communication between the main block 20 and the modules 26–32 are at a single face of the main block. This facilitates modularity and compactness. The modules are in abutting relation with the main block for the transfer of thermal energy to the modules. Bolts, not shown, pass through holes 52 in the modules and are received within internally-threaded bores on the bottom surface of the main block.

Figure 2:
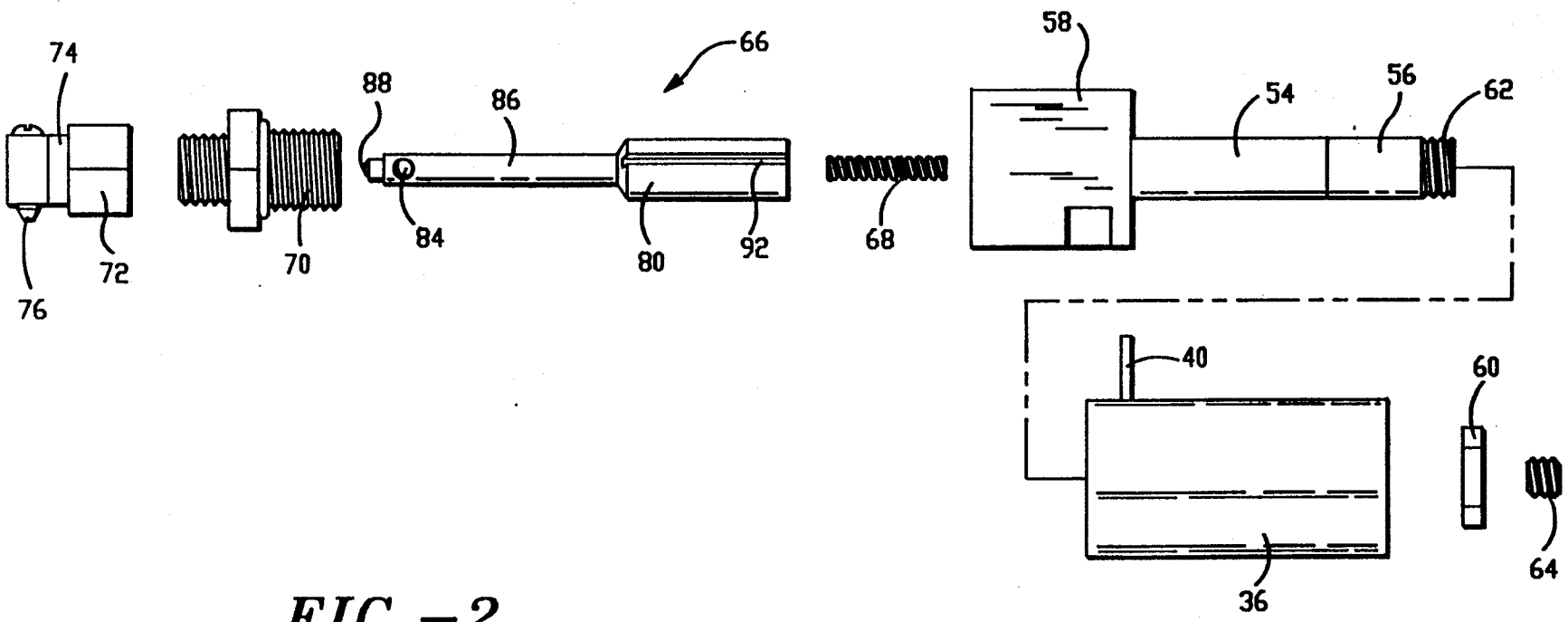
FIG. 2 is an exploded view of one of the modules of FIG. 1.

Referring now to FIG. 2, an exploded view of a module 26 is shown. The coil 36 has an axial passageway through a guide tube 54. The guide tube is a two-piece assembly, having a pole piece 56 at a rearward end. The pole piece is a solid member made of steel and brazed to the forward end of the guide tube 54. The forward end has an axial passage to receive a coil spring 68 and a solenoid armature 66. The forward end of the guide tube should be made of a material which is relatively magnetic transparent.

The coil 36 is secured to the guide tube 54 and a body member 58 of the module 26 by a nut 60 that is fastened to threads 62 of the guide tube. A set screw 64 is threaded into the pole piece 56 of the guide tube and cemented in place, so that rotation of the set screw rotates the guide tube. As will be explained more fully below, the position of the guide tube determines the stroke length of the solenoid armature 66. An alternative would be to manufacture the pole piece 56 to include a hexagonally-shaped hole, so that the guide tube could be rotated without concern of inadvertently freeing a set screw that has been cemented in position.

The conduction of current through the coil 36 generates a magnetic flux path that creates a magnetic attraction between the pole piece 56 and the solenoid armature 66. A coil spring 68 biases the armature against a valve seat 70. However, the solenoid action overcomes the bias of the coil spring 68 to displace the armature. The displacement of the armature allows the flow of adhesive through the valve seat 70. Threaded onto the end of the valve seat 70 opposite to the body member 58 is a nut 72 that secures a nozzle 74 having a nozzle outlet 76. The displacement of the solenoid armature 66 therefore controls intermittent flow of adhesive from the nozzle outlet.

Figure 3A:
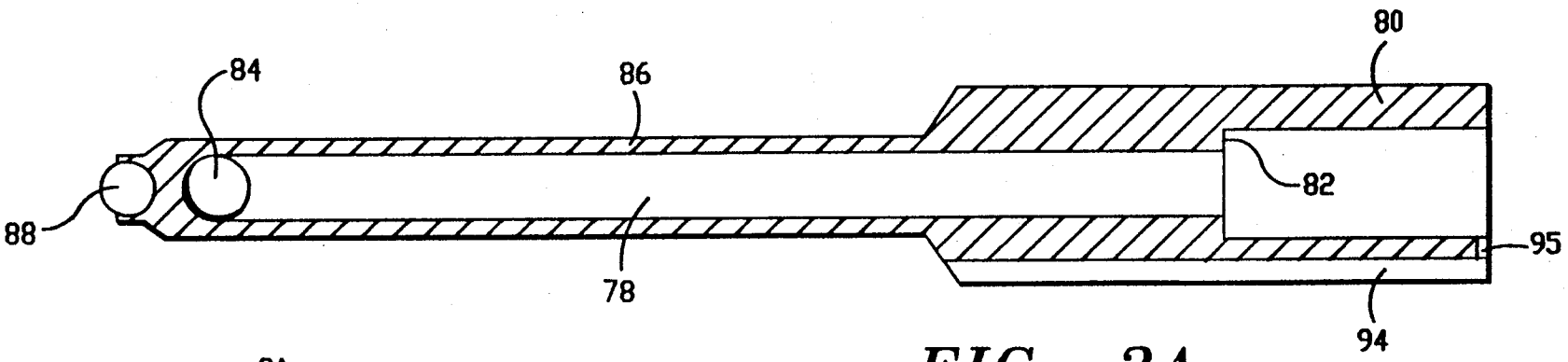
FIG. 3A is a side view of the solenoid armature of FIG. 2.
Figure 3B:
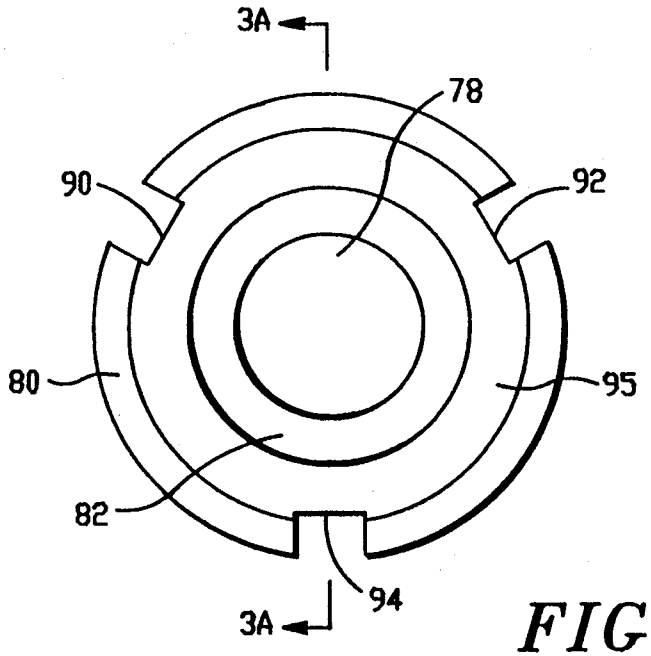
FIG. 3B is an end view of the solenoid armature of FIG. 3A.

Referring now to FIGS. 2, 3A and 3B, the armature 66 has a central bore 78 that is enlarged at a rearward portion 80 of the armature. The central bore at the rearward portion of the armature is dimensioned to receive the coil spring 68. Thus, the bias of the coil spring is applied at a shoulder 82 within the central bore of the armature.

The central bore 78 is open at the rearward portion 80 of the solenoid armature 66. A radial bore 84, best seen in FIGS. 2 and 3A, provides a passageway through the armature, with the exception of the forward tip. The forward tip has a spherical member 88 that is dimensioned to block an outlet port in the valve seat 70.

FIGS. 2 and 3B show the end of the rearward portion 80 of the solenoid armature 66 as including three longitudinal grooves 90, 92 and 94 along the exterior. The grooves provide a path to the rear of the armature. A recessed region 95 allows flow from each groove to the central bore 78, even in situations in which the armature abuts a planar surface, such as the forward end of the pole piece 56.

Figure 4:
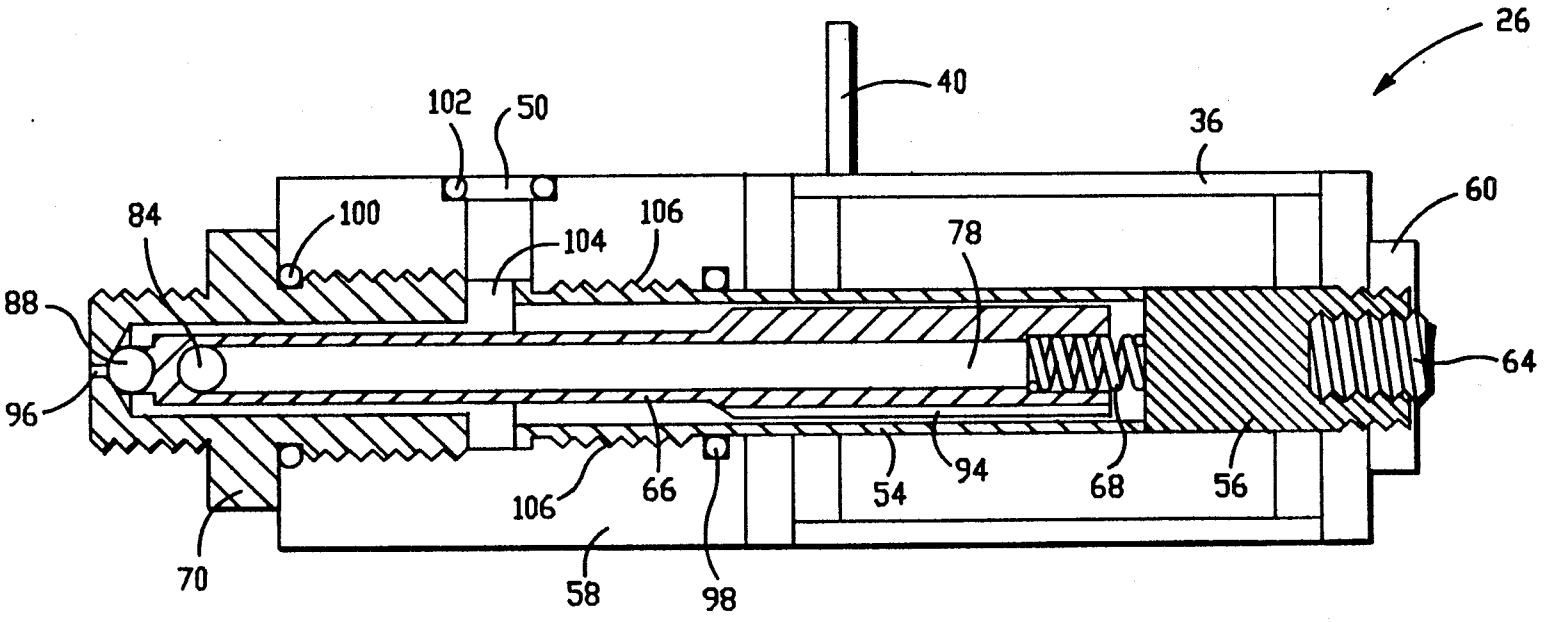
FIG. 4 is a side sectional view of a module of FIG. 2.

The module is shown in a fully assembled condition in FIG. 4. The solenoid armature 66 is shown in a sealed position in which the spherical member 88 at the tip of the armature contacts the valve seat 70 to prevent adhesive flow through an outlet port 96. The combination of the coil 36, the guide tube 54, the body member 58 and the valve seat 70 acts as a housing for the armature.

Three O-rings are shown in FIG. 4. A first O-ring 98 encircles the guide tube 54 proximate to the back end of the body member 58. The guide tube is shown as threaded into place. A second O-ring 100 is at the interface of the valve seat 70 and body member 58. A third O-ring 102 is at the inlet port 50 of the module 26.

As described above, conduction of a current through the coil 36 provides a force which overcomes the bias of the spring 68 to displace the armature 66 rearwardly. The rearward displacement opens the outlet port 96 for the passage of adhesive from the inlet port 50. Adhesive entering the inlet port is allowed to follow two paths. Nearly all of the adhesive will enter an adhesive-receiving chamber 104 and progress forwardly along the forward end of the armature 66 to the outlet port 96. From the outlet port the adhesive is extruded from the nozzle of the module 26.

However, while nearly all of the adhesive follows this forward, high-volume flow path to the outlet port 96, a small percentage of the adhesive from the inlet port 50 will follow a flow loop to the outlet port. Referring now to FIGS. 3B and 4, a low-volume rearward flow occurs along the grooves 90–94 in the surface of the armature. In an adhesive-release position, not shown, the armature 66 compresses the coil spring 68 and abuts the pole piece 56. The adhesive that has progressed along the grooves 90–94 flows through the recessed region 95 to enter the central bore 78 of the armature. Because the radial bore 84 is disposed within the high-volume flow path directly from the inlet port 50 to the outlet port 96, a pressure differential is created within the central bore 78 of the armature. The pressure at the end of the central bore 78 nearest the radial bore 84 is less than that at the coil spring 68. The adhesive within the central bore consequently joins the high-volume flow path to the outlet port.

In operation, power to energize the coil 36 is supplied at the two-prong plug 40. Energization displaces the armature 66 rearwardly to compress the coil spring 68. The forward flow is a high-volume flow directly from the inlet port 50 to the outlet port 96. A low-volume flow loop extends rearwardly from the adhesive-receiving chamber, along the grooves 90, 92 and 94 and into the central bore 78 of the armature. The forward portion of the flow loop is through the central bore for exit through the radial bore 84. An advantage of the flow loop is that the adhesive can enter along an intermediate portion of the armature without creation of stagnant regions in which adhesive is allowed to degrade. Flow takes place along the entirety of the armature without the entrance of adhesive at the back end of the module 26.

As noted above, the set screw 64 shown in FIGS. 2 and 4 may be adjusted to vary the stroke length of the armature 66. The set screw is cemented in position within the pole piece 56 at the rear of the guide tube 54, so that rotation of the set screw provides a corresponding rotation of the guide tube. Other means for allowing a user to rotate the guide tube may be used. For example, a hexagonally shaped hole may be broached into the pole piece or a knob may be fastened to the end of the pole piece. Because the guide tube is attached to the body member 58 by threads 106, turning the set screw in a clockwise direction moves the pole piece closer to the outlet port 96 of the valve seat 70. As a result, the armature 66 will have less space to travel from an adhesive-release position to the sealed position of FIG. 4 upon de-energization of the coil 36.

The ability to adjust the stroke length has a number of advantages. Firstly, a dynamic stroke adjustment allows a user to increase the speed of the shutoff of adhesive. As noted, clockwise rotation of the pole piece reduces the distance that the armature 66 must travel upon de-energization of the coil 36. Thus, the period required for adhesive shutoff is reduced. Secondly, a dynamic stroke adjustment permits a user to vary the flow rate of adhesive extrusion. Positioning the spherical member 88 closer to the outlet port of the valve seat 70 leaves a smaller cross sectional area between the spherical member and the valve seat, so that less adhesive is able to flow to the outlet port 96.

Another advantage of the dynamic stroke adjustment involves reducing the susceptibility of a module 26 to adhesive drool between successive adhesive applications. Upon de-energization of the coil 36, the armature 66 moves forwardly toward the outlet port 96 of the valve seat 70. There is a tapering effect as the spherical member 88 moves closer to the valve seat 70. The forward movement progressively reduces the cross sectional area between the spherical member and the valve seat, until the spherical member is brought into contact with the valve seat. Immediately prior to contact, the cross sectional area is so small that there is a susceptibility to adhesive drool. However, the susceptibility is reduced by rotating the guide tube 54 in a counterclockwise direction that brings the armature 66 further back when the armature is in the adhesive-release position. This provides a greater distance and time for the spring 68 to accelerate the armature 60 to a maximum velocity. Consequently, by the time that the spherical member 88 has reached the position in which the tapering effect is most likely to cause drool susceptibility, the armature has reached a velocity at which the final distance will be quickly traversed. Yet another advantage is that allowing a valve stroke adjustment of, for example, 0.01 to 0.015 reduces the necessity of manufacturing the individual parts of the module 26 to meet exacting dimensional tolerances. The adjustment by rotating the set screw 64 allows compensation for dimensional variations among the modules.

I claim:

1. A device for controlling the intermittent flow of adhesive material comprising, a housing having a bore and having a seat at an axially forward end of said bore, said seat having an outlet port, said housing having an inlet port in fluid communication with said bore, a reciprocating member slidably received in said bore, said reciprocating member having a forward end and a rearward end and having a sealed position in which said forward end is in contact with said seat to block fluid flow from said bore to said outlet port, said inlet port located along the length of said reciprocating member between said forward end and said rearward end, said housing and said reciprocating member defining an axially forward high-volume flow path from said inlet port to said outlet port via said bore and defining a predetermined low-volume flow loop extending from said inlet port to said rearward end of said reciprocating member and returning to join said high-volume flow path, and means for selectively displacing said reciprocating member to and from said sealed position.

2. The device of claim 1 wherein said reciprocating member has a central passageway open at said rearward end of said reciprocating member, said reciprocating member having a generally radial passageway from said central passageway to said high-volume flow path.

3. The device of claim 2 wherein said low-volume flow loop is a path along the exterior of said reciprocating member into said central passageway from said rearward end and out of said central passageway via said radial passageway, thereby entering said high-volume flow path.

4. The device of claim 1 wherein said reciprocating member is an armature and said displacing means is a solenoid coil.

5. The device of claim 1 further comprising means for biasing said reciprocating member into said sealed position.

6. The device of claim 3 wherein said reciprocating member has grooves along said exterior to form a portion of said low-volume flow loop.

7. A modular adhesive applicator comprising, a housing having an inlet port and an outlet port and a principal fluid passageway therebetween, fluid flow from said inlet port to said outlet port via said principal fluid passageway being a forward flow, a solenoid armature having a forward portion received within said principal fluid passageway and having a rearward portion on a side of said inlet port opposite to said outlet port, said solenoid armature having a central bore having a flow entrance at said rearward portion and a flow exit at said principal fluid passageway, thereby providing a minor flow passageway that is rearward from said inlet port to said flow entrance and then forward through said central bore into said principal passageway, means for biasing said solenoid armature into a sealed position blocking said outlet port, and means for producing a magnetic flux path overcome the bias of said biasing means.

8. The applicator of claim 7 wherein said solenoid armature has a generally cylindrical exterior at said rearward portion, said rearward portion having grooves along said generally cylindrical exterior to permit flow from said inlet port to said flow entrance at said rearward portion.

9. The applicator of claim 7 further comprising a main block having an adhesive supply channel and a means for conducting power, said adhesive supply channel having a plurality of openings for fluid communication with said inlet port of said housing and with inlet ports of housings identical to said housing, said means for conducting power having a plurality of identical connectors for electrical communication with a plurality of said means for producing a magnetic flux.

10. The applicator of claim 9 wherein said main block includes means for generating heat and wherein said housing is a member having a high thermal conductivity, said housing abutting said main block.

11. The applicator of claim 7 wherein said biasing means is a spring extending into said central bore.

12. A modular assembly for intermittently applying adhesive comprising, a main block having an adhesive supply channel and a power means for conducting power, said adhesive supply channel having a plurality of main block openings to release adhesive, said power means having a plurality of individually-energized connectors, a plurality of housings, each having an inlet port in fluid communication with one of said main block openings and each having a solenoid coil in electrical communication with one of said connectors of said power means, each housing having a seat having an outlet port, said inlet ports and said electrical communication with said connectors being at a single face of said main block, and a plurality of solenoid armatures having central bores having first openings at first ends of said solenoid armatures and having second openings proximate to second ends of said solenoid armatures, said solenoid armatures slidably received within said housings in alignment with said outlet ports for selectively preventing adhesive flow through said outlet ports, said inlet port of each housing located between said outlet port and said first end of said solenoid armature received within said housing, said solenoid armatures being spaced apart from said housings along first regions from said inlet ports to said outlet ports so as to define high-volume adhesive paths and along second regions from said inlet ports to said first ends to define low-volume adhesive paths, whereby, for each housing, energization of said solenoid coil causes flow from said adhesive supply channel of said main block to said outlet port via said high-volume adhesive path and causes a flow loop via said low-volume adhesive path and said central bore to enter said high-volume adhesive path.

13. The assembly of claim 12 wherein said main block includes a heater means for generating thermal energy, said housings mounted to said main block in high thermal energy transfer relation at said single face of said main block.

14. The assembly of claim 12 further comprising means for biasing said solenoid armatures in a sealed position to prevent adhesive flow through said outlet ports, 15. The assembly of claim 14 wherein said biasing means is a plurality of springs extending into said central bores of said solenoid armatures.

16. The assembly of claim 12 further comprising a plurality of nozzles in fluid communication with said outlet ports.

* * * * *